US006324292B1

(12) United States Patent
Mitsuhashi et al.

(10) Patent No.: US 6,324,292 B1
(45) Date of Patent: Nov. 27, 2001

(54) SPEAKER APPARATUS

(75) Inventors: Takashi Mitsuhashi; Hiroyuki Hamada, both of Saitama (JP)

(73) Assignee: Pioneer Corporation, Tokyo (JP)

( * ) Notice: Subject to any disclaimer, the term of this patent is extended or adjusted under 35 U.S.C. 154(b) by 0 days.

(21) Appl. No.: 09/416,048

(22) Filed: Oct. 12, 1999

(30) Foreign Application Priority Data

Oct. 14, 1998 (JP) ..... 10-292654

(51) Int. Cl.[7] ..... H04R 25/00

(52) U.S. Cl. ..... 381/349; 381/345; 381/348; 381/351; 381/353; 181/151; 181/160

(58) Field of Search ..... 381/303–305, 381/338, 345, 346, 348, 349, 351, 352, 353, 354; 181/148, 151, 160

(56) References Cited

U.S. PATENT DOCUMENTS 1,901,388 * 3/1933 Wolff ..... 381/351
3,680,658 * 8/1972 Goeskel ..... 181/151
4,837,837 * 6/1989 Taddeo ..... 381/346
4,889,208 * 12/1989 Sugihara ..... 381/351
5,333,204 * 7/1994 Hamada et al. ..... 381/346

* cited by examiner

*Primary Examiner*—Curtis Kuntz
*Assistant Examiner*—Suhan Ni
(74) *Attorney, Agent, or Firm*—Sughrue, Mion, Zinn, Macpeak & Seas, PLLC

(57) ABSTRACT

A speaker apparatus comprises a speaker unit, a cabinet for forming an internal space on the rear side of the speaker unit with a plurality of wall surfaces including a baffle plate for use in mounting the speaker unit, a acoustic tube which is formed along at least one wall surface out of the plurality of wall surfaces and has not only a substantially uniform hollow section but also an opening at one end, and an acoustical material for separating the internal space from the internal space of the acoustic tube by closing the opening of the acoustic tube. The speaker apparatus is characterized in that the acoustic tube has a tube length about 1/(2n) (n=positive integer) time as large as a wavelength corresponding to the lowest resonance mode of the standing wave produced along the one wall surface out of the standing waves produced in the internal space and that the opening is disposed close to the node of the standing wave.

28 Claims, 13 Drawing Sheets

SPEAKER APPARATUS

BACKGROUND OF THE INVENTION

1. Field of the Invention

This invention relates to a speaker apparatus capable of suppressing a standing wave in the cabinet of the speaker apparatus.

2. Description of the Related Art

As is well known, speaker units are acoustic transducers for emitting sound waves by vibrating diaphragms in response to electric signals (hereinafter called aural signals) carrying acoustic information. Such a speaker unit is rarely employed alone and it is usually fitted to a baffle plate in order to improve sound reproduction and used as a speaker apparatus.

Supposing the size of the baffle plate to which the speaker unit is fitted is unlimited, the interference of the sound wave emitted from across the diaphragm could be prevented completely. However, the speaker unit is actually fitted to a baffle plate of finite size.

The cabinet used in such a speaker is the one embodied therein. A baffle plate of finite size is generally used for one wall surface of a sealed-up or partially opened acoustic box.

FIG. 12 shows an example of a conventional speaker aparatus S showing one speaker unit fitted to a rectangular sealed-up cabinet.

As shown in FIG. 12, a speaker unit 102 is fitted to a baffle plate 101*a* of finite size formed on one side of a sealed-up cabinet 101. The diaphragm of the speaker unit 102 is driven longitudinally by an aural signal supplied from an input terminal (not shown), whereby sound waves corresponding to the aural signal are emitted from the surface side (the external space side) of the diaphragm so as to effect acoustic reproduction.

As the internal space of the cabinet 101 is a finite space of a cube in this case, the sound wave emitted from the back (on the internal space side) of the diaphragm into the internal space of the cabinet is reflected from a back plate 101*b* opposite to the baffle plate 101*a* or a base plate 101*d* opposite to a top plate 101*c* and caused to produce standing waves with the opposing wall surface positions as nodes.

The standing wave produced between the wall surfaces at this time includes a higher mode corresponding to a resonance frequency n times (n=positive integer) as great as the lowest resonance mode in addition to a standing wave (the lowest resonance mode) having a wavelength equivalent to what is substantially twice as great as the distance between the wall surfaces.

FIG. 12A shows the lowest resonance modes 103 and 104 out of the standing waves respectively produced between the top plate 101*c* and the base plate 101*d* and between the baffle plate 101*a* and the back plate 101*b* in the cabinet 101, and FIG. 12B shows higher modes 103*a* and 104*a* respectively having resonance frequencies twice as great as the lowest resonance modes out of the standing waves thus produced, that is, having a wavelength half as short as the lowest resonance mode.

These standing waves produced within the cabinet 101 function as those which impair the movement of the diaphragm of the speaker unit 102, which constitutes a primary factor of deteriorating the quality of the sound reproduced by the speaker apparatus S.

Consequently, various contrivances have heretofore been made to ease the standing waves produced in a cabinet as much as possible as shown by examples of speaker apparatus in FIGS. 13A to 13C.

More specifically, the sound pressures of the standing waves have been attenuated by mounting an acoustical material 105 such as glass wool on the inner wall surface of the cabinet 101 as shown in FIG. 13A. The standing waves within the cabinet 101 have also been suppressed as much as possible by mounting a Helmholtz resonator 106 exhibiting resonance at a particular frequency on the inside of the cabinet 101 as shown in FIG. 13B or otherwise using a cabinet 107 having an irregular shape in place of the cubic cabinet 101 so as to eliminate the parallel wall surfaces as shown in FIG. 13C.

In order to satisfactorily attenuate the sound pressures of the standing waves produced in the cabinet 101 by mounting the acoustical material 105 on the inner wall surface of the cabinet 101, however, a considerable amount of acoustical material 105 needs using and as this results in increasing the acoustic resistance, the lower register would be absorbed too.

Though the helmholtz resonator 106 acts on a standing wave at the specific wavelength generated in the cabinet, for example, because it has the effect of absorbing sound at a single resonance frequency, it will not effectively act on a standing wave having any other wavelength.

Moreover, the use of the cabinet 107 having an irregular shape tends to make the speaker apparatus complicated in structure and costly and furthermore to restrict its designing.

SUMMARY OF THE INVENTION

An object of the present invention made in consideration of the foregoing problems is to provide a speaker apparatus which is quite simple in structure and capable of satisfactorily suppressing standing waves in a cabinet.

A speaker apparatus according to a first aspect of the invention comprises a speaker unit, a cabinet for forming an internal space on the rear side of the speaker unit with a plurality of wall surfaces including a baffle plate for use in mounting the speaker unit, a acoustic tube which is formed along at least one wall surface out of the plurality of wall surfaces and has not only a substantially uniform hollow section but also an opening at one end, and an acoustical material for separating the internal space from the internal space of the acoustic tube by closing the opening of the acoustic tube, wherein the acoustic tube has a tube length about 1/(2n) (n=positive integer) time as large as a wavelength corresponding to the lowest resonance mode of the standing wave produced along the one wall surface out of the standing waves produced in the internal space and that the opening is disposed close to the node of the standing wave.

According to a second aspect of the invention, in the speaker apparatus of the first aspect, the wall surface of the acoustic tube constitutes at least part of the wall surface belonging to an acoustic path formed in the internal space.

According to a third aspect of the invention, in the speaker apparatus of the first aspect, at least part of the acoustic tube constitutes a reinforcing material for reinforcing the structure of the cabinet.

According to the invention, even though a standing wave is produced in the internal space of the cabinet when the speaker unit is driven to operate, the standing wave is satisfactorily suppressed because the acoustic tube attenuates and absorbs the standing wave by performing tube resonance together with using the acoustical material fitted to the acoustic tube so as to negate the standing wave.

DETAILED DESCRIPTION OF THE PREFERRED EMBODIMENTS

Preferred embodiments of the invention will now be described with reference to the drawings.

Figure 1:
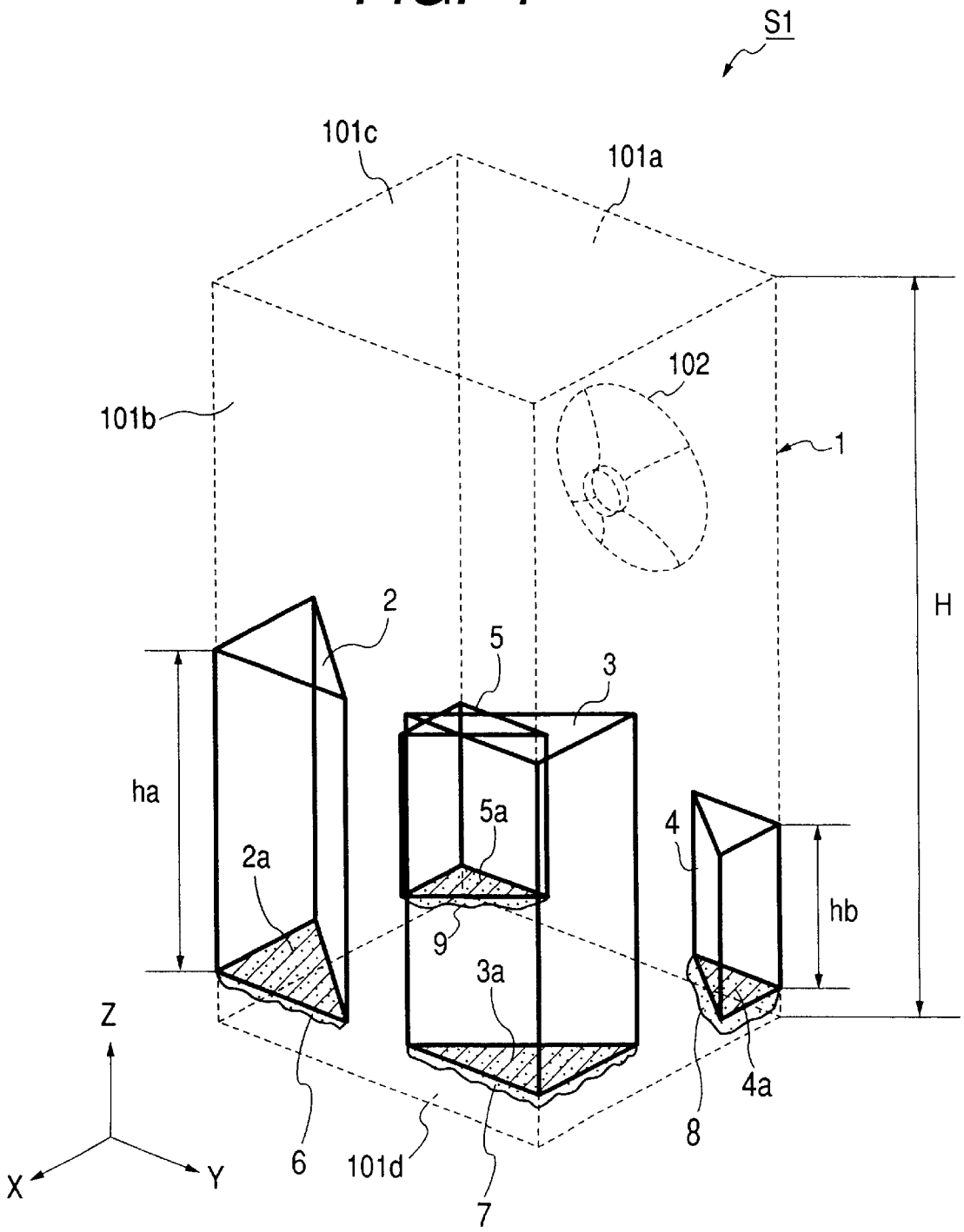
FIG. 1 is a diagram showing the internal structure of the cabinet of a speaker apparatus S1 embodying the invention.

FIG. 1 is a diagram showing the internal structure of the cabinet of a speaker apparatus S1 embodying the invention. A cabinet 1 in this case is a sealed-up cabinet so that its internal space may be cubic.

The cabinet 1 is such that a sealed-up space is formed on the rear face side of a speaker unit 102 with each of the wall surfaces (six wall surfaces including one baffle plate 101*a* in FIG. 1) including a baffle plate 101*a* to which the speaker unit 102 is fitted so as to acoustically separate the external space of the speaker unit 102 from its internal space. In other words, the formation of the sealed-up space prevents sound waves emitted from the front and back of the diaphragm of the speaker unit 102 fitted to the baffle plate 101*a* from interfering with each other. Incidentally, this sealed-up space has a predetermined capacity that is adjusted to various properties of the speaker unit 102 in order to obtain acoustic characteristics necessary for the speaker apparatus S1.

As shown in FIG. 1, moreover, acoustic tubes 2, 3, 4 and 5 are provided on the wall surface in the cabinet 1. Each of the acoustic tubes is a hollow tube in the form of a triangular prism and has a closed one end and the other open end. Therefore, the section of each acoustic tube in the horizontal direction (a direction parallel to the X-Y plane of FIG. 1) becomes a substantially uniform hollow section (triangular in this case) Acoustical materials 6, 7, 8 and 9 are fitted in the openings 2*a*, 3*a*, 4*a* and 5*a* of the respective acoustic tubes.

The acoustic tubes 2, 3, 4 and 5 and the acoustical materials 6, 7, 8 and 9 are provided to suppress the standing waves provided in the cabinet 1 when the speaker unit 102 is driven to operate. In order to suppress the standing wave produced in the vertical direction (the direction of Z in FIG. 1) of the sealed-up space by the two wall surfaces of the top plate 101*c* and the base plate 101*d* parallel to each other in the cabinet 1, the opening of each acoustic tube is disposed so as to face the base plate 101*d*.

The acoustic tubes 2 and 3 are of the same shape and their tube length ha (the length ranging from the closed one end up to the other open end of each acoustic tube in this case) is about half the distance H between the wall surfaces of the top plate 101*c* and the base plate 101*d* of the cabinet 1. The openings 2*a* and 3*a* of the acoustic tubes 2 and 3 are disposed so as to face each other via a slight gap relative to the base plate 101*d* of the cabinet 1. Further, the acoustical materials 6 and 7 are fitted in the respective openings 2*a* and 3*a* in such a way as to close the openings 2*a* and 3*a*.

The acoustic tubes 4 and 5 are of the same shape and their tube length hb is a quarter of the distance H between the wall surfaces of the top plate 101*c* and the base plate 101*d* of the cabinet 1. The openings 4*a* and 5*a* of the acoustic tubes 4 and 5 are disposed so as to face each other via a slight gap relative to the base plate 101*d* of the cabinet 1. Further, the acoustical materials 8 and 9 are fitted in the respective openings 4*a* and 5*a* in such a way as to close the openings 4*a* and 5*a*.

The acoustic tubes 2, 3, 4 and 5 within the cabinet 1 and the acoustical materials 6, 7, 8 and 9 are thus mounted in and fixed to the inside of the cabinet 1. When the speaker unit 102 is driven to operate, the standing waves produced in the cabinet 1 are suppressed by the resonance waves produced by the tubular resonance of the acoustic tubes 2, 3, 4 and 5.

The operation of suppressing the standing waves produced in the cabinet 1 to be performed by the acoustic tubes and the acoustical materials will now be described.

Figure 2A:
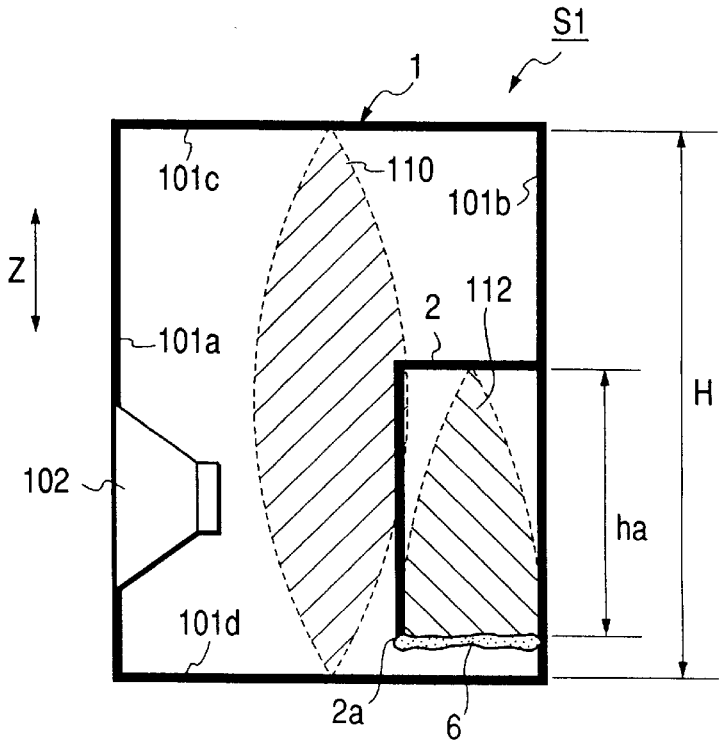
FIGS. 2A and 2B are diagrams showing in an exemplary way the standing wave produced in the vertical direction (the direction of Z in FIGS. 2A and 2B) within the cabinet, and the resonance wave produced by the acoustic tube and the acoustical material during the driving of the speaker unit in the speaker apparatus S1.
Figure 2B:
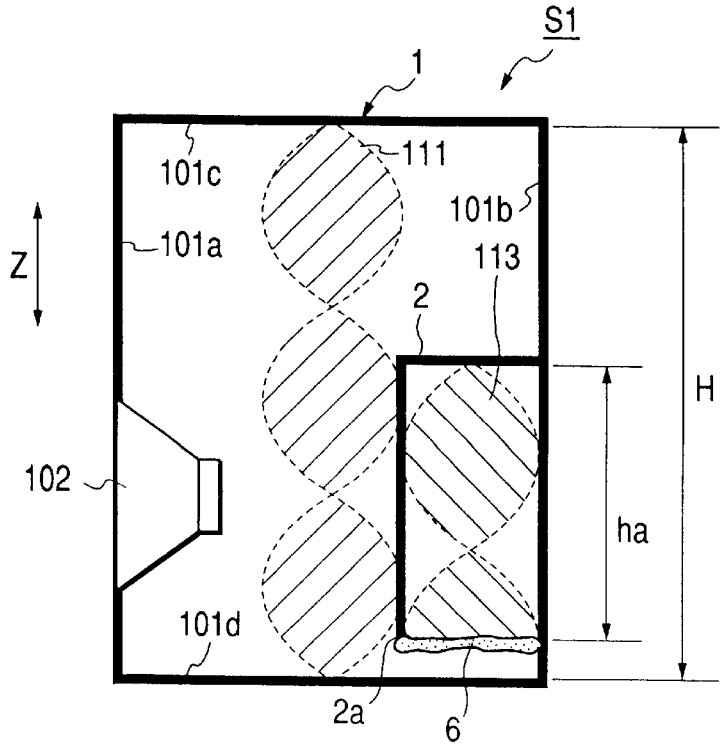

FIGS. 2A and 2B show in an exemplary way the standing wave produced in the vertical direction (the direction of Z in FIGS. 2A and 2B) within the cabinet 1, and the resonance wave produced by the acoustic tube 2 and the acoustical material 6 during the driving of the speaker unit 102 fitted to the cabinet 1 of the speaker apparatus S1 in FIG. 1.

In the direction of Z within the cabinet 1, the lowest resonance mode and its higher mode with the inner wall surfaces of the top plate 101*c* and the base plate 101*d* as nodes and with the distance H in the direction of Z being $\lambda/2$ ($\lambda$: wavelength) are produced as standing waves. Moreover, the opening 2*a* of the acoustic tube 2 fitted with the acoustical material 6 is located near the node of the standing wave produced in the direction of Z within the cabinet 1 (near the base plate 101*d* of the cabinet 1 in FIGS. 2A and 2B). Therefore, the acoustic tube 2 having the acoustical material 6 exhibits tube resonance when the speaker unit 102 is driven to operate and produces a resonance wave corresponding to the tube length.

This resonance wave is a resonance wave with the closed one end of the acoustic tube 2 as its node and with the proximity of the opening 2*a* as its belly.

FIG. 2A refers to a case where there is produced a standing wave 110 with the distance H being λ/2 (i.e., the lowest resonance mode out of the standing wave produced in the direction of Z), and FIG. 2B to a case where there is produced a standing wave 111 with the distance H being 3λ/2 (i.e., a higher mode having a resonance frequency three times as great as the lowest resonance mode out of the standing wave produced in the direction of Z).

In FIG. 2A, though the standing wave 110 is produced in the cabinet 1 when the speaker unit 102 is driven to operate, a resonance wave 112 equivalent to about ¼ wavelength of the standing wave 110 is produced from the tube resonance as the acoustic tube 2 has a tube length ha equivalent to about ¼ wavelength of the standing wave 110 in this case.

The standing wave 110 and the resonance wave 112 whose acoustic impedance becomes higher in positions closer to their respective nodes and whose acoustic impedance becomes lower in positions closer to their bellies exhibit: that the particle velocity (the air flow) is finely distributed in the former case;

and that the particle velocity is coarsely distributed in the latter case. Consequently, as shown in FIG. 2A, the node of the resonance wave 112 is disposed close to the belly of the standing wave 110, and the belly of the resonance wave 112 is disposed close to the node of the standing wave 110. In other words, the resonance wave 112 functions as what eases a difference in the particle velocity distribution in the cabinet 1 resulting from the standing wave 110 when the resonance wave 112 having the opposite particle velocity distribution is added to the standing wave 110, so that the acoustic tube 2 fitted with the acoustical material 6 suppresses the amplitude of the standing wave 110.

Further, as shown in FIG. 2B, a resonance wave 113 equivalent to about ¾ wavelength of a standing wave 111 is produced by the tube resonance since the acoustic tube 2 has a tube length ha equivalent to about ¾ wavelength of the standing wave 111 when the standing wave 111 is produced within the cabinet 1.

Like the aforementioned resonance wave 112 relative to the standing wave 110 of FIG. 2A, the resonance wave 113 is such that the node of the resonance wave 113 is disposed close to the belly of the standing wave 111, and the belly of the resonance wave 113 is disposed close to the node of the standing wave 111. In other words, the resonance wave 113 functions as what eases a difference in the particle velocity distribution in the cabinet 1 resulting from the standing wave 111 when the resonance wave 113 having the opposite particle velocity distribution is added to the standing wave 111, so that the acoustic tube 2 fitted with the acoustical material 6 suppresses the amplitude of the standing wave 111.

Thus, the acoustic tube 2 fixedly mounted in the cabinet 1 has a tube length ha equivalent to the ¼ wavelength of the lowest resonance mode out of the standing wave produced in the direction of Z in the cabinet 1, and generates the resonance wave with its closed one end as the node and with the opening 2*a* as its belly, whereby the higher mode having a resonance frequency 2n−1 times (n=positive integer) as great as the lowest resonance mode including the standing waves 110 and 111 can be suppressed likewise.

Although the cabinet 1 and the acoustic tube 2 may be regarded as a combined body of two acoustic tubes coupled together by the opening 2*a* from the standpoint of the speaker unit 102, the internal space of the acoustic tube 2 and that of the cabinet 1 are separated by the acoustical material 6 from each other in view of an acoustic space. Hence, new standing waves other than the aforementioned resonance waves 10 to 13 based on the resonance of the combined body of these two acoustic tubes can also be prevented from being generated in the cabinet 1.

The operation of suppressing the standing wave produced in the direction of Z within the cabinet 1 by the acoustical material 6 and the acoustic tube 2 has been described above. As the same applies to the case of using the acoustical material 7 and the acoustic tube 3, the description thereof will be omitted in order to avoid repetition.

Figure 3A:
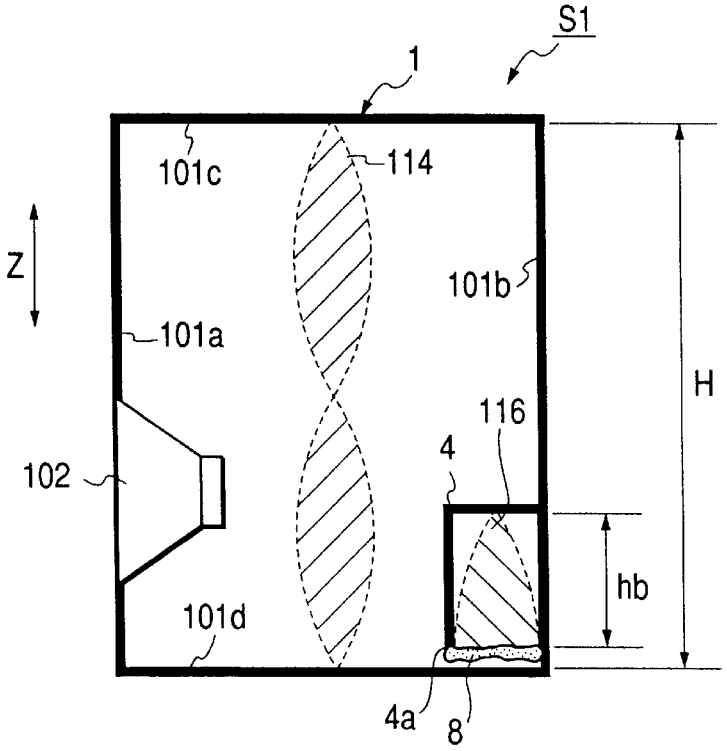
FIGS. 3A and 3B are diagrams showing in an exemplary way the standing wave produced in the vertical direction (the direction of Z in FIGS. 3A and 3B) within the cabinet, and the resonance wave produced by the acoustic tube and the acoustical material during the driving of the speaker unit in the speaker apparatus S1.
Figure 3B:
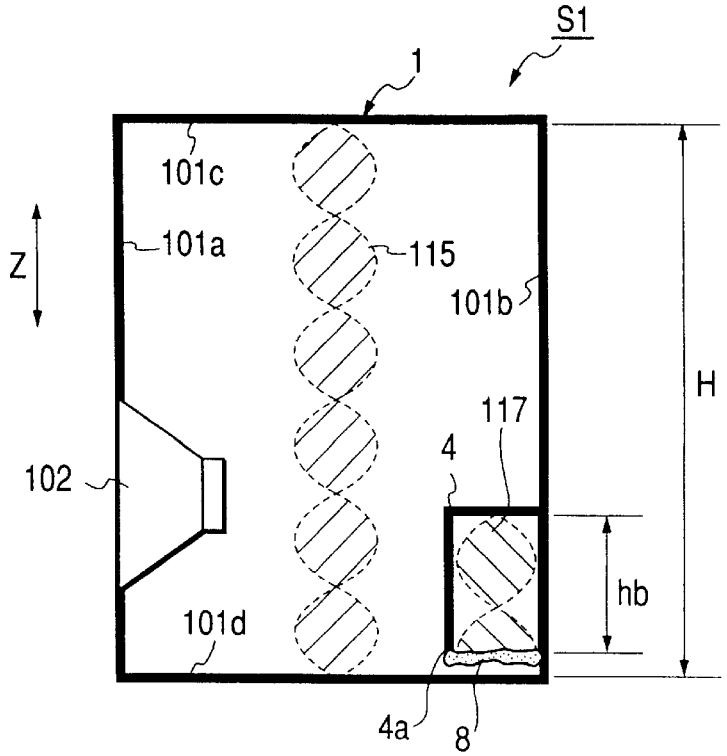

FIGS. 3A and 3B show in an exemplary way the standing wave produced in the vertical direction (the direction of Z in FIGS. 3A and 3B) within the cabinet 1, and the resonance wave produced by the acoustic tube 4 and the acoustical material 8 during the driving of the speaker unit 102 fitted to the cabinet 1 of the speaker apparatus S1 in FIG. 1.

FIG. 3A refers to a case where there is produced a standing wave 114 with the distance H being λ (i.e., a higher mode having a resonance frequency twice as great as the lowest resonance mode out of the standing wave produced in the direction of Z), and FIG. 3B to a case where there is produced a standing wave 115 with the distance H being 3λ (i.e., a higher mode having a resonance frequency six times as great as the lowest resonance mode.

In FIG. 3A, though the standing wave 114 is produced in the cabinet 1 when the speaker unit 102 is driven to operate, a resonance wave 116 equivalent to about ¼ wavelength of the standing wave 114 (⅛ of the wavelength of the lowest resonance mode) is produced from the tube resonance as the acoustic tube 4 has a tube length hb equivalent to about ¼ wavelength of the standing wave 114 in this case.

The standing wave 114 and the resonance-wave 116 whose acoustic impedance becomes higher in positions closer to their respective nodes and whose acoustic impedance becomes lower in positions closer to their bellies exhibit: that the particle velocity (the air flow) is finely distributed in the former case; and that the particle velocity is coarsely distributed in the latter case. Consequently, as shown in FIG. 3A, the node of the resonance wave 116 is disposed close to the belly of the standing wave 114, and the belly of the resonance wave 116 is disposed close to the node of the standing wave 114. In other words, the resonance wave 116 functions as what eases a difference in the particle velocity distribution in the cabinet 1 resulting from the standing wave 114 when the resonance wave 116 having the opposite particle velocity distribution is added to the standing wave 114, so that the acoustic tube 4 fitted with the acoustical material 8 suppresses the amplitude of the standing wave 114.

Further, as shown in FIG. 3B, a resonance wave 117 equivalent to about ¾ wavelength of a standing wave 115 is produced by the tube resonance since the acoustic tube 4 has a tube length hb equivalent to about ¾ wavelength of the standing wave 115 when the standing wave 115 is produced within the cabinet 1.

Like the aforementioned resonance wave 116 relative to the standing wave 114 of FIG. 3A, the resonance wave 117 is such that the node of the resonance wave 117 is disposed close to the belly of the standing wave 115, and the belly of the resonance wave 117 is disposed close to the node of the standing wave 115. In other words, the resonance wave 117 functions as what eases a difference in the particle velocity distribution in the cabinet 1 resulting from the standing wave 115 when the resonance wave 117 having the opposite particle velocity distribution is added to the standing wave 115, so that the acoustic tube 4 fitted with the acoustical material 8 suppresses the amplitude of the standing wave 115.

Thus, the acoustic tube 4 fixedly mounted in the cabinet 1 has a tube length hb equivalent to the ⅛ wavelength of the lowest resonance mode out of the standing wave produced in the direction of Z in the cabinet 1, and generates the resonance wave with its closed one end as the node and with the opening 4*a* as its belly, whereby the higher mode having a resonance frequency 2(2n−1) times (n=positive integer) as great as the lowest resonance mode including the standing waves 114 and 115 can be suppressed likewise.

As the suppressing operation performed by the acoustical material 9 and the acoustic tube 5 in FIGS. 3A and 3B is similar to what is performed by the acoustical material 8 and the acoustic tube 4, the description thereof will be omitted in order to avoid repetition.

As set forth above, the standing waves produced in the direction of Z within the cabinet 1 can be suppressed by the acoustic tubes 2, 3, 4 and 5 and the acoustical materials 6, 7, 8 and 9 in the cabinet 1.

Figure 4:
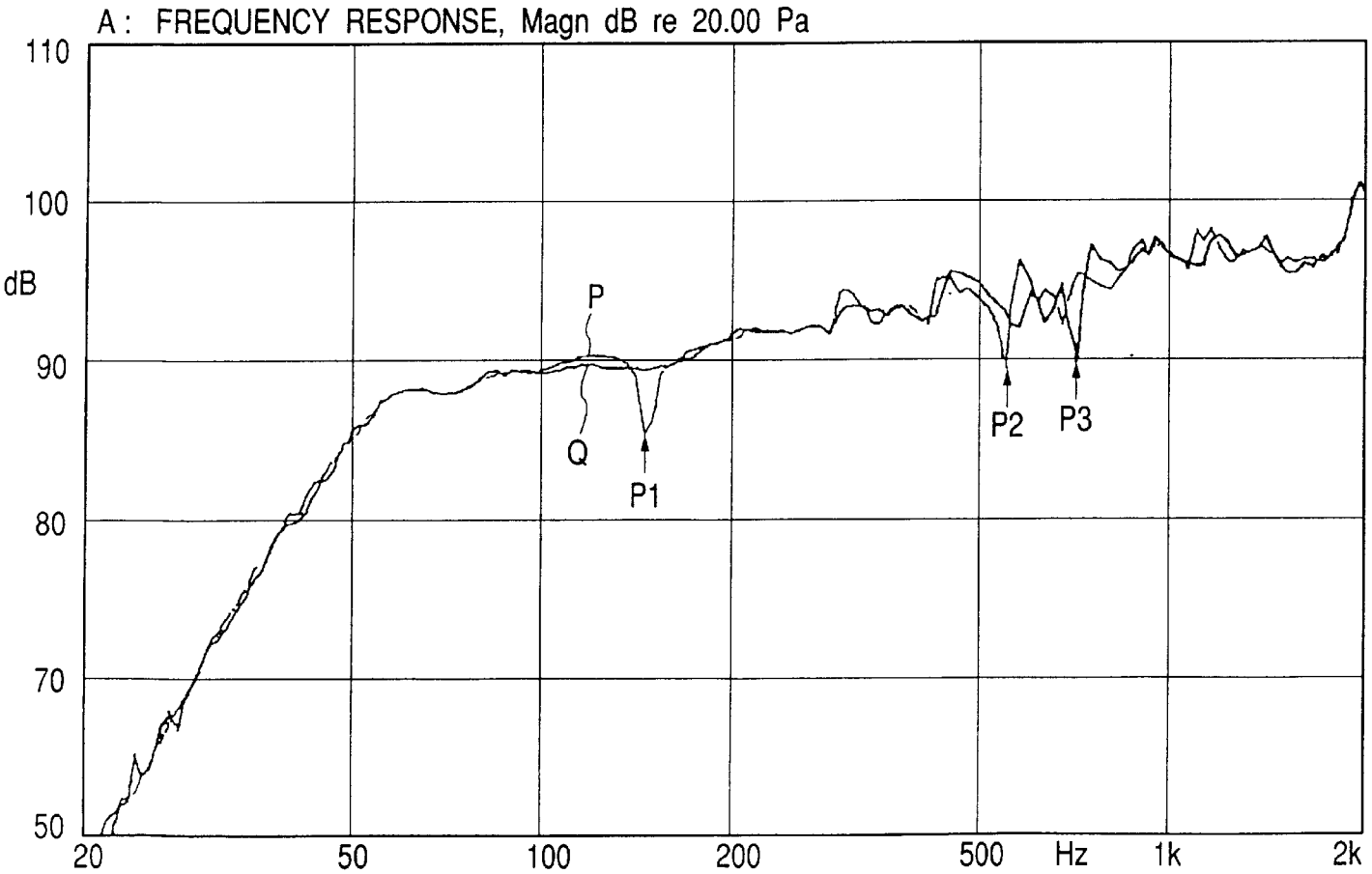
FIG. 4 is a graph showing reproduced sound pressure frequency characteristics obtained by actually measuring the speaker apparatus S1.

FIG. 4 shows a graph of reproduced sound pressure frequency characteristics obtained by actually measuring the speaker apparatus S1, wherein Q represents the reproduced sound pressure frequency characteristics of the speaker apparatus S1; and P, reproduced sound pressure frequency characteristics in a case where the acoustic tubes 2, 3, 4 and 5 and the acoustical materials 6, 7, 8 and 9 of the speaker apparatus S1 are removed. In Fig, 4, the vertical axis is shown by sound pressures (dB) and the horizontal axis by frequencies (Hz).

As is obvious from FIG. 4, the standing waves (the lowest resonance mode (i.e., corresponding to p1 therein) and its higher mode (i.e., corresponding to p2 and p3)) produced in the direction of Z within the cabinet 1 are seen to be satisfactorily suppressed by providing the acoustic tubes 2, 3, 4 and 5 and the acoustical materials 6, 7, 8 and 9 in the cabinet 1.

An example of the speaker apparatus S1 described above has been arranged so that two kinds of acoustic tubes each having about ½ and ¼ tube lengths of the distance H in the direction of Z together with the corresponding acoustical materials may be fixedly mounted in the cabinet 1 in pairs along the direction of Z within the cabinet 1. However, the invention is not limited to that example but may have acoustic tubes whose length can be about 1/(2n) time (n=positive integer of 2 or greater) as large as the wavelength of the lowest resonance mode out of the standing wave produced in the cabinet. One or more than one kind of acoustic tube having such a tube length is arranged so that the opening of the acoustic tube is located close to a position corresponding to the node of the standing wave used for suppressing the opening together with using an acoustical material fixedly mounted in the cabinet in such a way as to close the opening. Thus, the amplitude of a standing wave corresponding to the resonance wave produced in each acoustic tube can be suppressed.

Moreover, one or a plurality of acoustic tubes having the same tube length may be fixedly mounted in the cabinet along the standing wave involved so as to suppress the standing wave in the cabinet.

Figure 5:
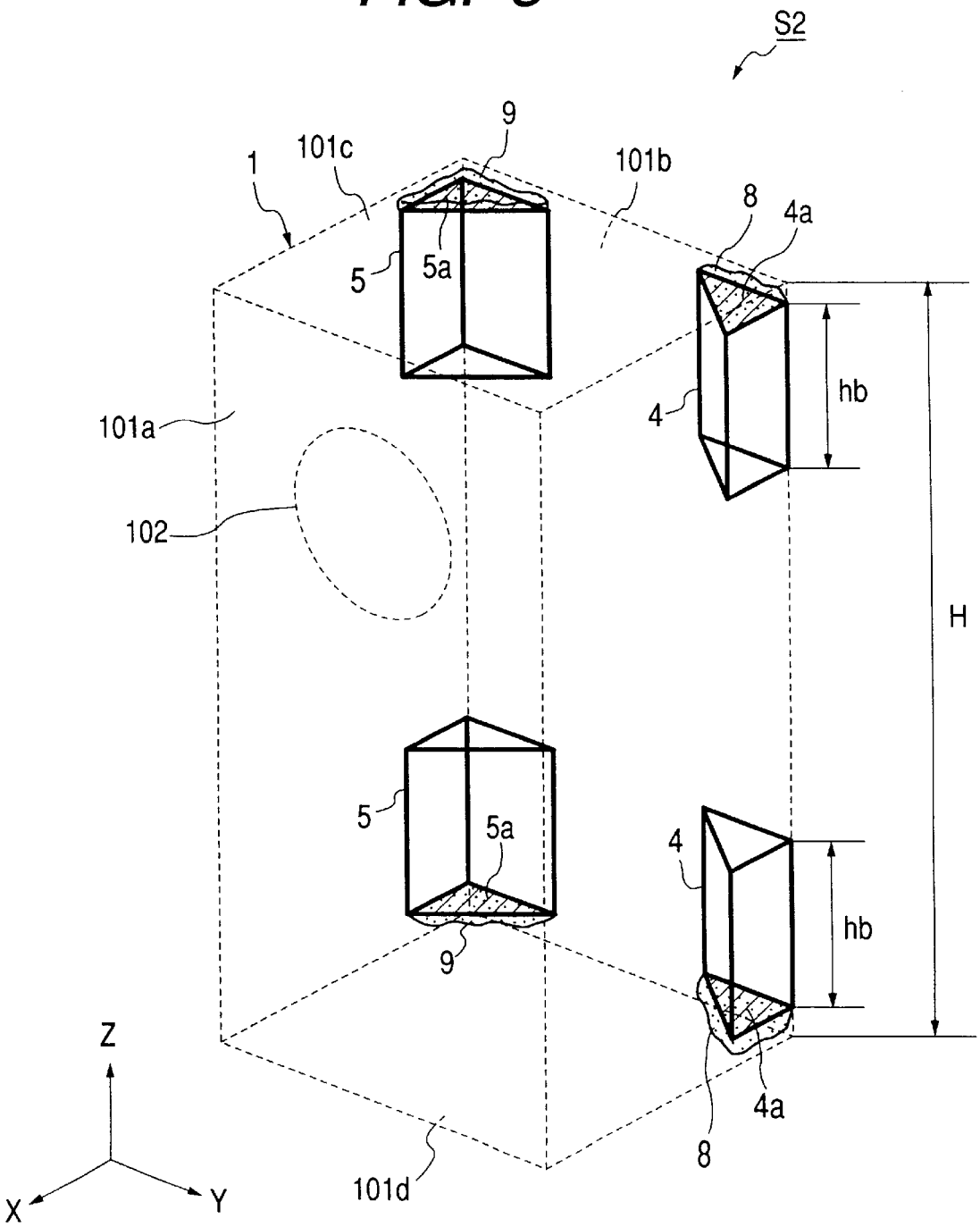
FIG. 5 is a diagram showing another speaker apparatus S2 embodying the invention.

FIG. 5 is a diagram showing another speaker apparatus S2 embodying the invention. In this speaker apparatus S2, the acoustic tubes 4 and 5 fitted with the acoustical materials 8 and 9 in such a way as to close the respective openings 4*a* and 5*a* are fixedly mounted in pairs (four pieces in total) along the direction of Z within the cabinet 1. Even in this arrangement, the standing wave produced in the direction of Z within the cabinet 1 is suppressed by each of the acoustic tubes and acoustical materials.

Figure 6:
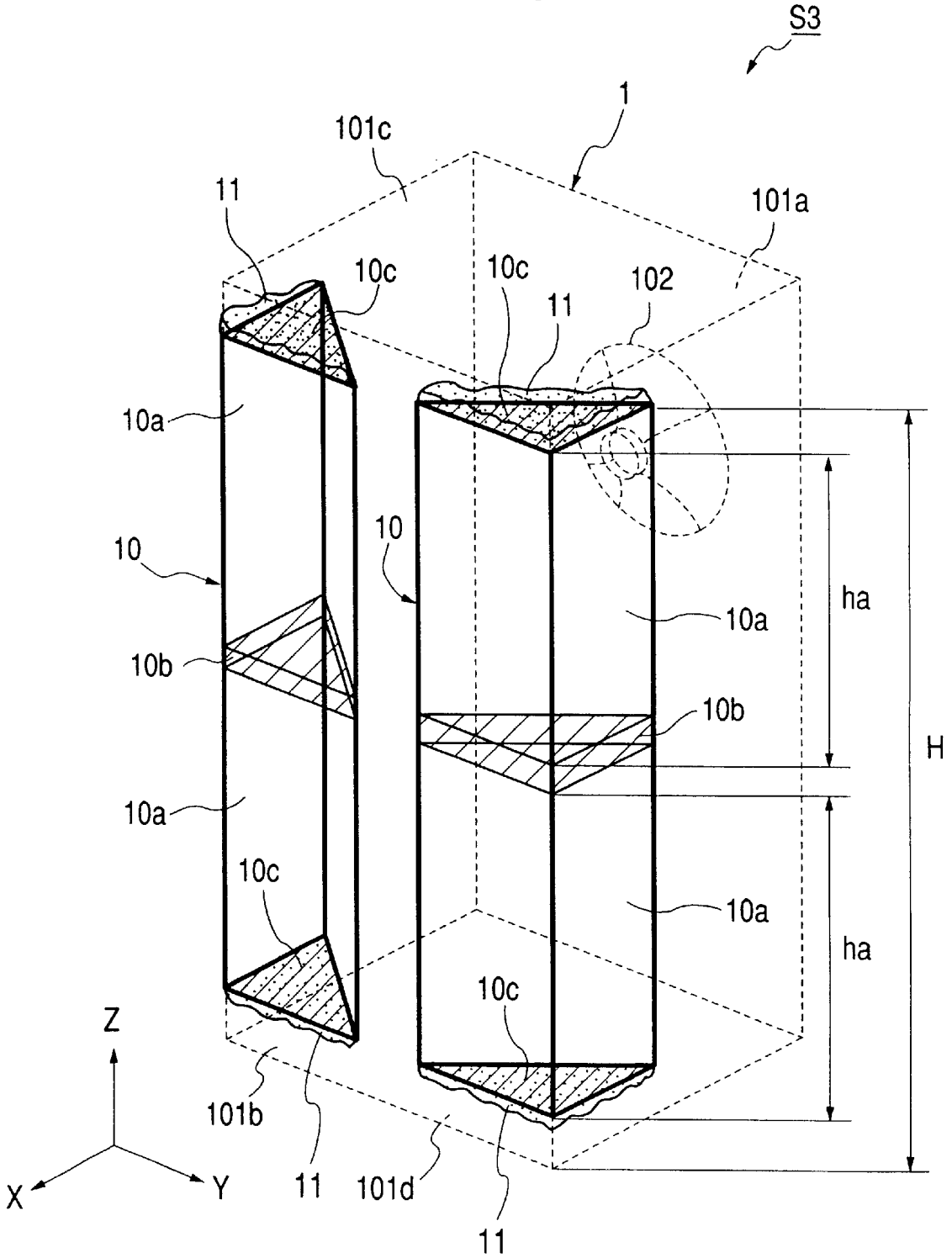
FIG. 6 is a diagram showing another speaker apparatus S3 embodying the invention.

FIG. 6 is a diagram showing still another speaker apparatus S3 embodying the invention. In this speaker apparatus S3, two triangular prisms 10 each with both ends opened are fixed along the direction of Z. A parting strip 10*b* in the central portion is used for dividing each acoustic tube 10 so that four acoustic tubes 10*a* equal to the acoustic tubes 2 and 3 shown in FIGS. 2A and 2B may be formed. Further, acoustical materials 11 are used for respectively closing two openings 10*c*, and each opening 10*c* of the acoustic tube 10*a* is disposed close to the node of the lowest resonance mode out of the standing wave produced in the direction of Z within the cabinet 1. The standing wave produced in the direction of Z within the cabinet 1 of the speaker apparatus S3 can also be suppressed with the arrangement above.

Figure 7:
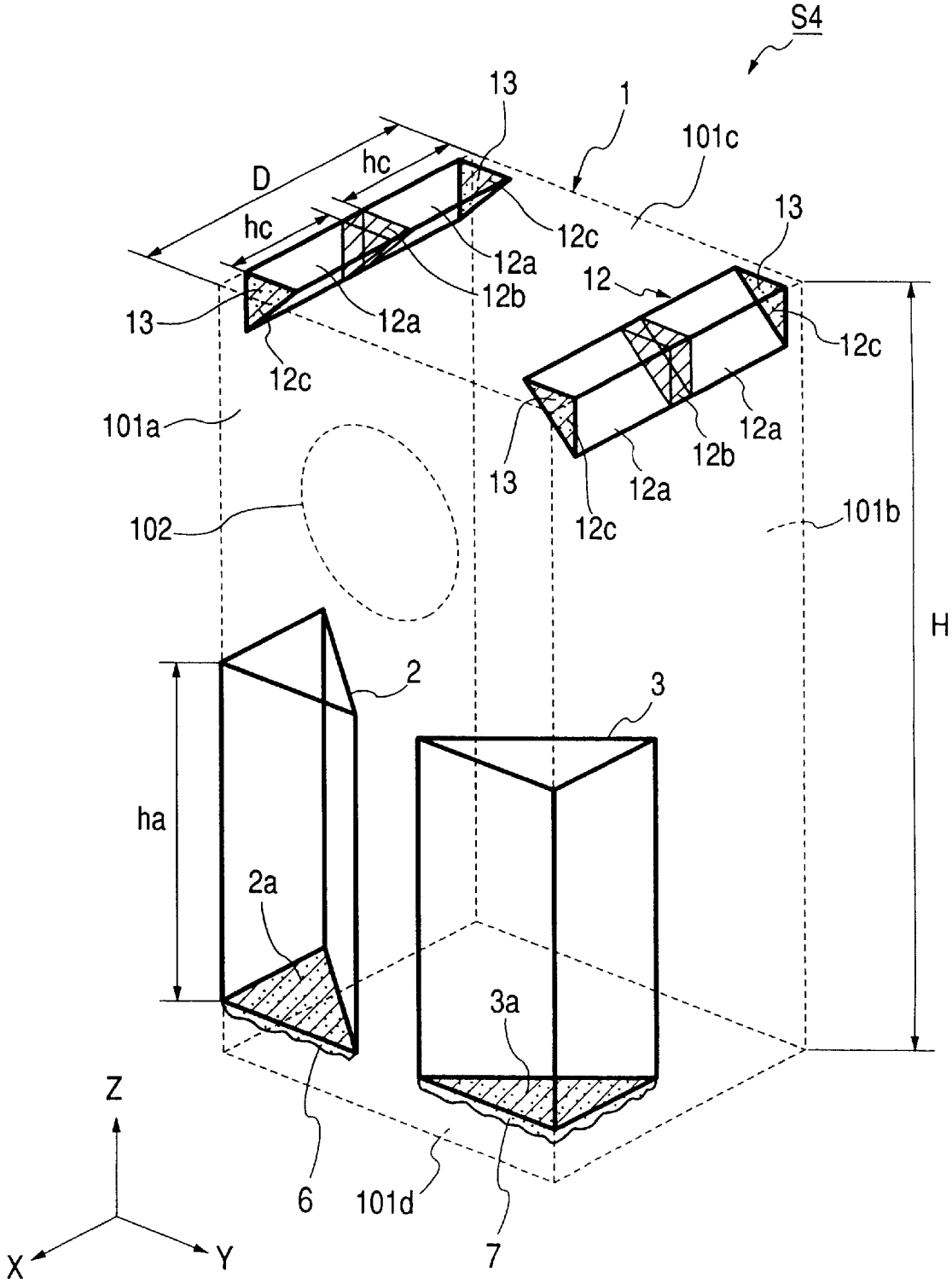
FIG. 7 is a diagram showing another speaker apparatus S4 embodying the invention.

Moreover, the standing wave produced in a plurality of positions can be suppressed by arranging a plurality of acoustic tubes each fitted with acoustical materials in their openings in order to deal with the standing wave produced in a plurality of different directions including not only the direction of Z but also the depth direction (X-direction) and the lateral direction (Y-direction) within the cabinet 1 of the speaker apparatus. FIG. 7 shows such a speaker apparatus as described above.

FIG. 7 is a diagram showing still another speaker apparatus S4 embodying the invention. In this speaker apparatus S4, the acoustic tubes 2 and 3 and the acoustical materials 6 and 7 fitted in the respective openings 2*a* and 3*a* are fixedly mounted along the direction of Z within the cabinet 1 as shown in FIG. 1. Further, four acoustic tubes 12*a* fitted with acoustical materials 13 respectively fitted in openings 12*c* are fixedly mounted along the direction of X (i.e., the depth direction in which the baffle plate 101*a* and the back plate 101*b* of the cabinet 1 face each other) perpendicularly crossing the direction of Z within the cabinet 1 of the speaker apparatus S4.

In this case, two hollow tubes 12 in the form of a triangular prism are respectively divided by parting strips 12*b* in their center portions into four acoustic tubes 12*a*, whereby each acoustic tube 12*a* is formed so that its length may be about ½ of the distance D between the baffle plate 101*a* and the back plate 101*b* of the cabinet 1. The acoustical material 13 is fitted in the opening 12*c* of each acoustic tube 12*a* in such a way as to close the opening 12*c*. The acoustic tube 12*a* fitted with the acoustical material 13 has a tube length hc equivalent to about ¼ wavelength of the lowest resonance mode out of the standing wave produced in the direction of X within the cabinet 1. Each opening 12*c* has a slight gap so that it may be positioned close to the node of the lowest resonance mode out of the standing wave produced in the direction of X within the cabinet 1.

Thus, the standing wave produced in the direction of Z within the cabinet 1 of the speaker apparatus S4 is suppressed by the acoustic tubes 2 and 3 and the acoustical materials 6 and 7, whereas the standing wave produced in the direction of X is suppressed by the four acoustic tubes 12 and the acoustical materials 13.

In the aforementioned embodiment, though each acoustic tube is the hollow tube in the form of a triangular prism having a closed one end and the other open end and fixedly mounted in the cabinet 1, the hollow sectional configuration of each acoustic tube is not limited to the triangular prism but may be circular or have any other configuration. Moreover, the material used to form the acoustic tube may be what has suitable acoustic absorptivity or a reflection factor as long as it produces a resonance wave capable of suppressing a standing wave.

Figure 8:
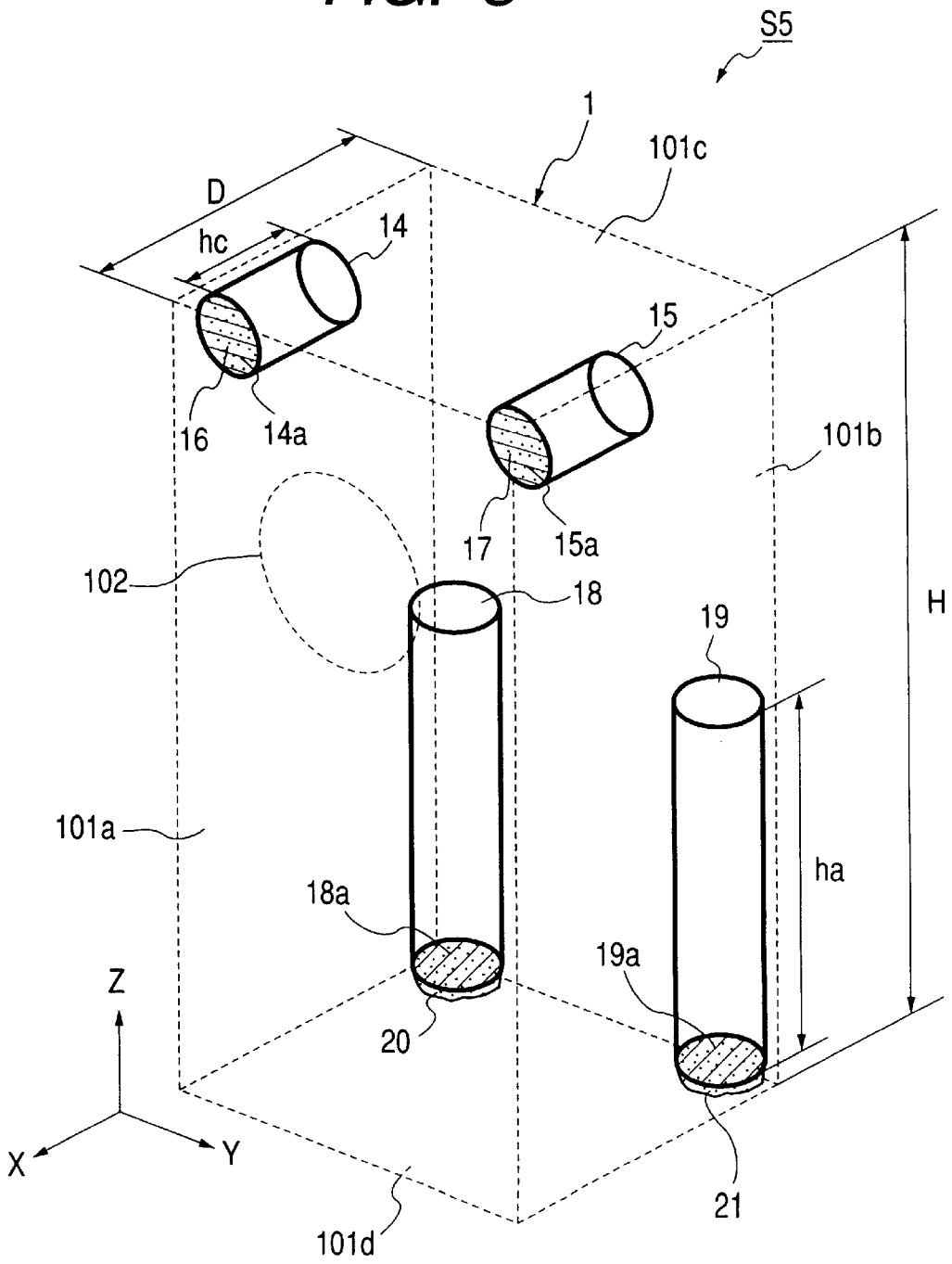
FIG. 8 is a diagram showing still another speaker apparatus S5 embodying the invention wherein paper tubes having a circular hollow section are used to form acoustic tubes.

FIG. 8 is a diagram showing still another speaker apparatus S5 embodying the invention wherein paper tubes having a circular hollow section are used to form acoustic tubes.

In the speaker apparatus S5, two paper tubes 14 and 15 as hollow tubes each having closed one ends and the other open ends 14*a* and 15*a* are fixedly mounted along the direction of X within the cabinet 1. Each of the paper tubes 14 and 15 has a tube length hc of about ½ of the distance D between the baffle plate 101*a* and the back plate 101*b* of the cabinet 1.

Acoustical materials 16 and 17 are fitted in the openings 14*a* and 15*a* in such as way as to close the openings 14*a* and 15*a*. The paper tubes 14 and 15 fitted with the acoustical materials 16 and 17 has a tube length hc of about ¼ wavelength of the lowest resonance mode out of the standing wave produced in the direction of X within the cabinet 1. Each of the openings 14*a* and 15*a* has a slight gap relative to the baffle plate 101*a* so that it may be positioned close to the node of the lowest resonance mode out of the standing wave produced in the direction of X within the cabinet 1.

In the speaker apparatus S5, moreover, two paper tubes 18 and 19 as hollow tubes each having closed one ends and the other open ends 18*a* and 19*a* are fixedly mounted along the direction of Z within the cabinet 1. Each of the paper tubes 18 and 19 has a tube length ha of about ½ of the distance H between the inner wall of the top plate 101*c* and that of the base plate 101*d* of the cabinet 1.

Acoustical materials 20 and 21 are fitted in the respective openings 18*a* and 19*a* in such as way as to close the openings 18*a* and 19*a*. The paper tubes 18 and 19 fitted with the acoustical materials 20 and 21 has a tube length ha of about ¼ wavelength of the lowest resonance mode out of the standing wave produced in the direction of Z within the cabinet 1. Each of the openings 18*a* and 19*a* has a slight gap relative to the base plate 101*d* of the cabinet 1 so that it may be positioned close to the node of the lowest resonance mode out of the standing wave produced in the direction of Z within the cabinet 1.

Thus, the standing wave produced in the direction of X within the cabinet 1 of the speaker apparatus S5 is suppressed by the acoustic tubes 14 and 15 and the acoustical materials 16 and 17, whereas the standing wave produced in the direction of Z is suppressed by the acoustic tubes 18 and 19 and the acoustical materials 20 and 21.

Although the acoustic tube has been formed into a tubular shape and fixedly mounted in the cabinet in the embodiments stated above, the invention is not limited to those embodiments but may be such that part of the acoustic tube is formed with the wall surface of the cabinet. An embodiment of the acoustic tube partially formed with the wall surface of the cabinet will subsequently be described.

Figure 9:
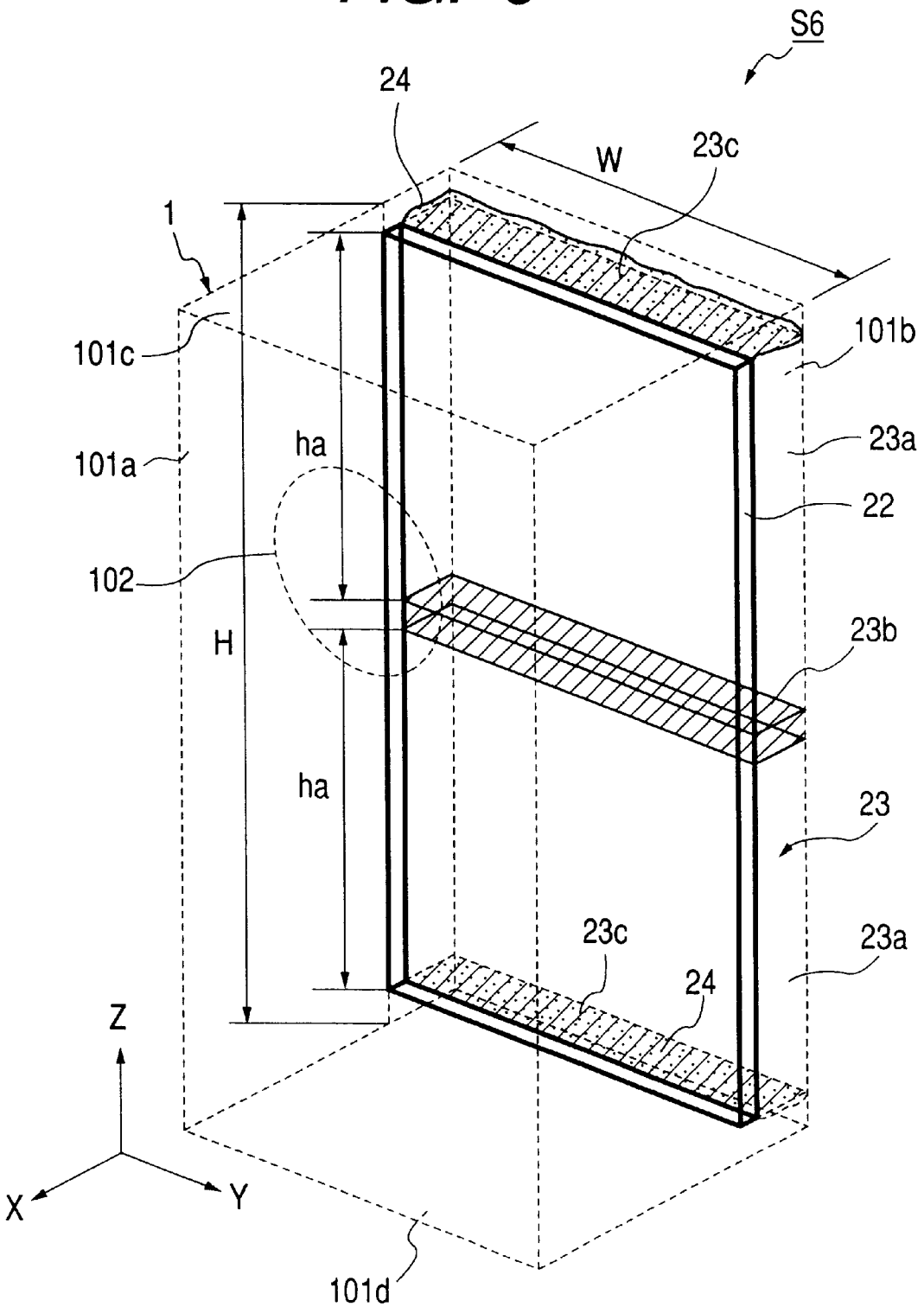
FIG. 9 is a diagram showing another speaker apparatus S6 embodying the invention.

FIG. 9 is a diagram showing still another speaker apparatus S6 embodying the invention. In this speaker apparatus S6, the space in the cabinet 1 is partitioned by fixedly mounting a rectangular plate 22 in the cabinet 1 in parallel to the baffle plate 101*a*, the rectangular plate 22 having a width equal to the distance W (the direction of Y in FIG. 9) between both side walls holding the baffle plate 101*a* of the cabinet 1 therebetween. Thus, a hollow tube 23 is formed by the rectangular plate 22, the back plate 101*b* and the lateral side wall surfaces of the cabinet 1.

The hollow tube 23 is divided by a parting strip 23*b* in the center portion into two acoustic tubes 23*a*. In other words, each acoustic tube 23*a* is a hollow tube having one end closed by the parting strip 23*b* and the other end forming an opening 23*c*, and has a tube length ha of about ½ of the aforementioned distance H.

Acoustical materials 24 are fitted in the respective openings 23*c* of the acoustic tubes 23*a* in such as way as to close the openings 23*c*. Each acoustic tube 23*a* fitted with the acoustical material 24 has a tube length ha of about ¼ wavelength of the lowest resonance mode out of the standing wave produced in the direction of Z within the cabinet 1. Each opening 23*c* has a slight gap relative to the top plate 101*c* or base plate 101*d* of the cabinet 1 so that it may be positioned close to the node of the lowest resonance mode out of the standing wave produced in the direction of Z within the cabinet 1.

Thus, the standing wave produced in the direction of Z within the cabinet 1 of the speaker apparatus S6 is suppressed by the two acoustic tubes 23*a* and the two acoustical materials 24.

As part of each acoustic tube 23*a* is formed by the back plate and part of both side wall surfaces holding the back plate 101*b* of the cabinet 1 in the speaker apparatus S6, the acoustic tube production cost is curtailed and the space in the cabinet 1 is effectively utilizable.

As the cabinet 1 is reinforced by the rectangular plate 22 forming the acoustic tubes 23*a*, moreover, the rectangular plate 22 forms part of the acoustic tube 23*a* and simultaneously a reinforcing material for reinforcing the structure of the cabinet 1, whereby the diaphragm vibration of the cabinet 1 resulting from driving the speaker unit 102 to operate can be suppressed.

Although the speaker apparatus in each embodiment of the invention has been described with reference to what is fitted with a closed-type cabinet 1, the invention is not limited to those speaker apparatus as described but may be applicable to, for example, bass-reflex type, backloaded horn type and frontloaded horn type speaker apparatus.

Figure 10:
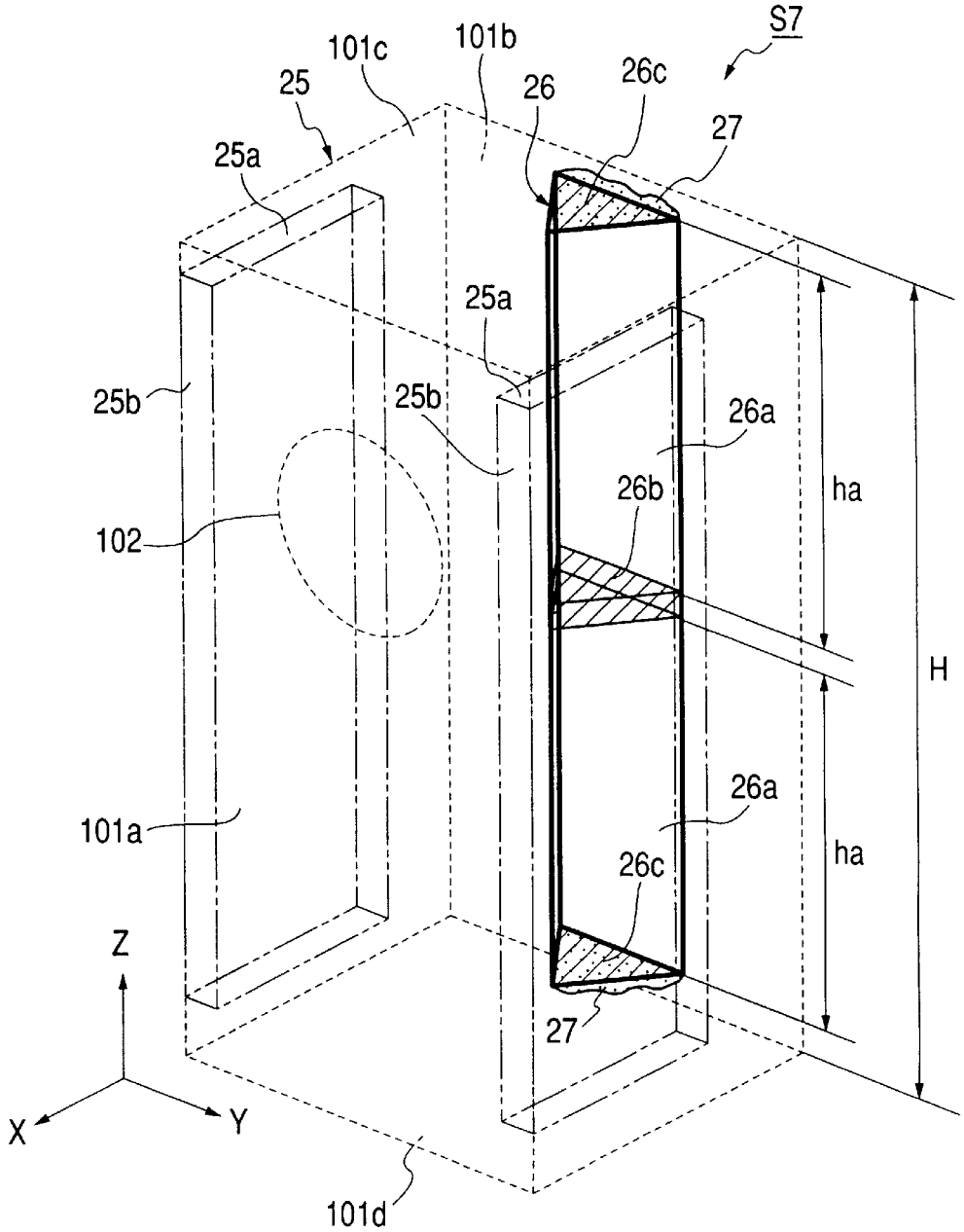
FIG. 10 is a diagram showing a bass-reflex type speaker apparatus S7 embodying the invention.

FIG. 10 is a diagram showing a bass-reflex type speaker apparatus S7 embodying the invention.

Referring to FIG. 10, acoustic ports 25*a* having openings 25*b* are formed in the internal space of a cabinet 25 that the speaker apparatus S7 has and when the speaker unit 102 is driven to operate, the sound emitted from the back side of the diaphragm of the speaker unit 102 facing the inside of the cabinet 25 is led forward by the acoustic ports 25*a*.

In the speaker apparatus S7, the center portion of a hollow tube 26 in the form of a triangular prism with both ends being open is partitioned by a parting strip 26*b* and fixed to the back plate 101*b* along the direction of Z within the cabinet 25 whereby to form two acoustic tubes 26*a*. More specifically, each acoustic tube 26*a* is a hollow tube having one end portion closed by the parting strip 26*b* and an opening 26*c* at the other end, and has a tube length ha of about ½ of the distance H between the top plate 101*c* and the base plate 101*d* of the cabinet 25.

Acoustical materials 27 are fitted in the respective openings 26*c* of the acoustic tubes 26*a* in such as way as to close the openings 26*c*. Each acoustic tube 26*a* fitted with the acoustical material 27 has a tube length ha of about ¼ wavelength of the lowest resonance mode out of the standing wave produced in the direction of Z within the cabinet 1. Each opening 26*c* has a slight gap relative to the top plate 101*c* or base plate 101*d* of the cabinet 25 so that it may be positioned close to the node of the lowest resonance mode out of the standing wave produced in the direction of Z within the cabinet 25.

Thus, the standing wave produced in the direction of Z within the cabinet 1 of the speaker apparatus S7 is suppressed by the two acoustic tubes 26*a* and the two acoustical materials 27.

Figure 11:
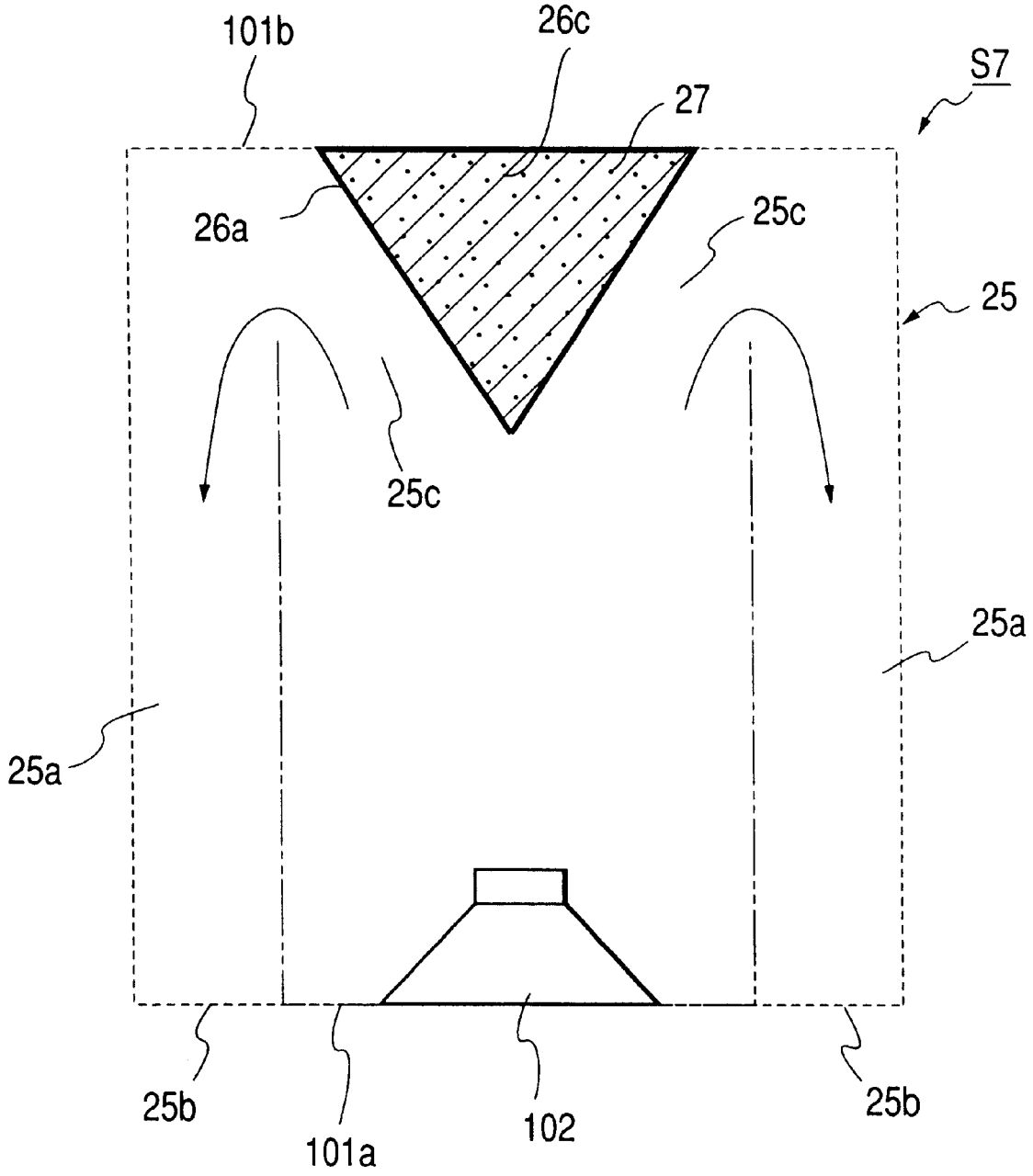
FIG. 11 is a plan view (as seen from the top plate 101*c*) of a speaker apparatus S7.
Figure 12A:
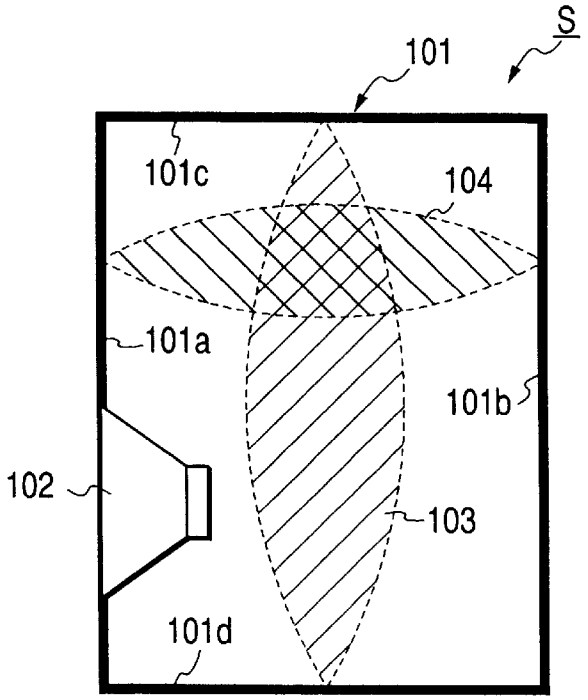
FIGS. 12A and 12B are diagrams showing an example of a conventional speaker apparatus.
Figure 12B:
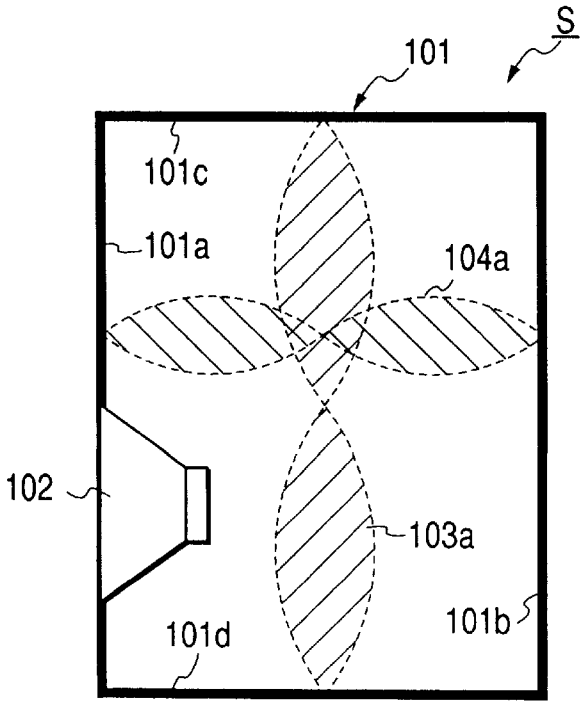
Figure 13A:
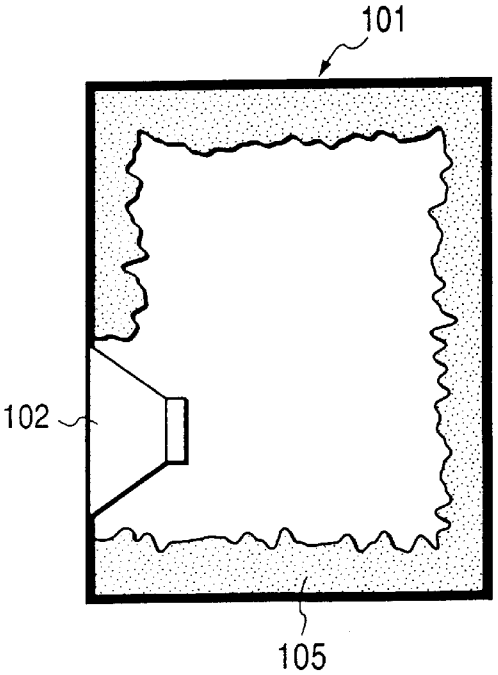
FIGS. 13A, 13B and 13C are diagrams showing examples of conventional speaker apparatus.
Figure 13B:
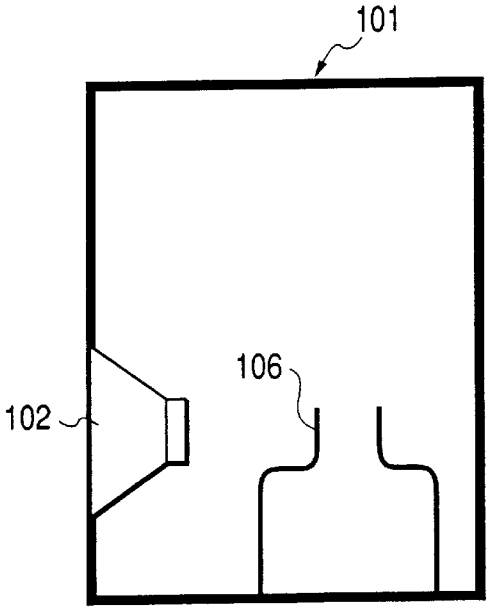
Figure 13C:
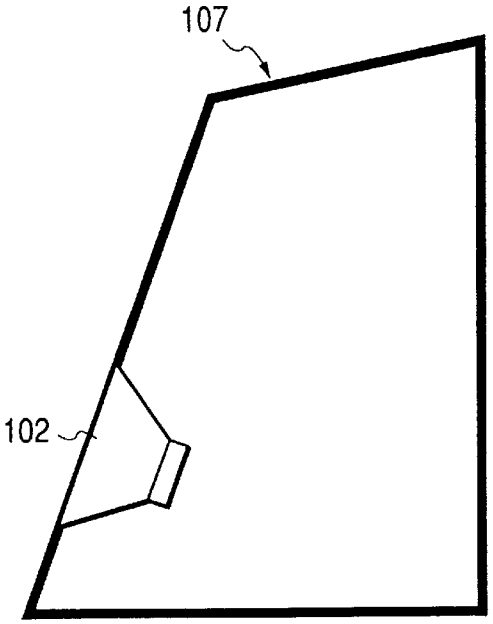

FIG. 11 is a plan view (as seen from the top plate 101*c*) of the speaker apparatus S7. The sound produced from the internal space side of the diaphragm of the speaker unit 102 and emitted into the internal space of the cabinet 25 is led outside as shown by arrows from acoustic paths 25*c* formed by triangular prism-like wall surfaces of the acoustic tube 26*a* and the acoustic ports 25*a* via the acoustic ports 25*a* and the openings 25*b*.

As the triangular prism-like outer wall surfaces of the acoustic tube 26 form part of the wall surfaces having the acoustic paths 25*c* formed in the internal space of the cabinet 25, the standing wave produced in the direction of Z within the cabinet 25 of the speaker apparatus S7 is suppressed by the acoustic tube 26*a* and the acoustical material 27. Therefore, regarding the sound emitted from the speaker unit 102 to the external space by the acoustic paths 25*c* and the acoustic ports 25*a*, the standing wave produced in the direction of Z within the cabinet 25 is satisfactorily suppressed.

In the speaker apparatus in each embodiment described above, one or the plurality of acoustic tubes are fixedly mounted in the cabinet by coinciding the acoustic tube with the direction in which the standing wave is produced on the basis of a standing wave to be suppressed. Further, each opening in which the acoustical material is fitted is made to face the inner wall surface of the cabinet and also disposed in a position having a slight gap relative to the inner wall surface. Further, the opening is disposed close to the node of the standing wave involved so as to arrange the particle velocity distribution derived from the resonance wave in the acoustic tube opposite to the particle velocity distribution derived from the standing wave whereby to suppress the standing wave within the cabinet. However, the invention is not limited to the arrangement described above.

In other words, the acoustic tube is such that the particle velocity distribution of the standing wave is only needed to be reversed with the particle velocity distribution of the standing wave. The acoustic tube is caused to function even when the direction of fixing it deviates from the direction of the standing wave and can thus be put to practical use then.

It is not always necessary to arrange each opening close to the inner wall surface of the cabinet and disposing the opening close to the node of a standing wave (the lowest resonance mode or its higher mode) to be suppressed makes it possible to obtain the same effect.

According to the invention, even though a standing wave is produced in the internal space of the cabinet when the speaker unit is driven to operate, the standing wave is satisfactorily suppressed because the acoustic tube which has a tube length about 1/(2n) (n=positive integer) time as large as a wavelength corresponding to the lowest resonance mode of the standing wave and is formed along at least one wall surface of the internal space attenuates and absorbs the standing wave by performing tube resonance together with using the acoustical material fitted to the acoustic tube so as to negate the standing wave.

What is claimed is:

1. A speaker apparatus comprising:

a speaker unit;

a cabinet for forming a first internal space on the rear side of said speaker unit with a plurality of wall surfaces including a baffle plate for use in mounting said speaker unit;

an acoustic tube for forming a second internal space, said acoustic tube being formed along at least one wall surface out of said plurality of wall surfaces and having a substantially uniform hollow section and an opening at one end; and an acoustical material for separating said first internal space from said second internal space by closing said opening of said acoustic tube;

wherein said acoustic tube has a tube length about 1/(2n) (n=positive integer) times as large as a wavelength corresponding to a lowest resonance mode of a standing wave produced along said one wall surface out of said standing waves produced in said first internal space and that said opening is disposed close to a node of said standing wave.

2. A speaker apparatus as claimed in claim 1, wherein a tube wall surface of said acoustic tube constitutes at least part of said wall surface belonging to an acoustic path formed in said first internal space.

3. A speaker apparatus as claimed in claim 1, wherein at least part of said acoustic tube constitutes a reinforcing material for reinforcing the structure of said cabinet.

4. A speaker apparatus as claimed in claim 1, wherein said acoustic tube is located at a corner in said cabinet.

5. A speaker apparatus as claimed in claim 1, wherein said n is 2 or greater.

6. A speaker apparatus as claimed in claim 1, wherein said first acoustic tube has a triangular hollow section.

7. A speaker apparatus as claimed in claim 1, wherein said first acoustic tube has a circular hollow section.

8. A speaker apparatus as claimed in claim 1, wherein said first acoustic tube is made of paper.

9. A speaker apparatus per claim 1, wherein said cabinet is an acoustic suspension cabinet so that said first and second internal spaces do not communicate with air outside of said cabinet.

10. A speaker apparatus per claim 1, wherein said tube has an opening only at one end.

11. A speaker apparatus comprising;

a speaker unit;

a cabinet mounted to said speaker unit;

a first acoustic tube which has a first opening, said first opening of said first acoustic tube being covered with an acoustic material;

wherein a length of said first acoustic tube is about 1/(2n) (n=positive integer) times as large as a wavelength corresponding to a lowest resonance mode of a first standing wave, wherein said first acoustic tube is disposed at a location to absorb said first standing wave produced in said cabinet.

12. A speaker apparatus as claimed in claim 11, wherein said first opening faces a first wall of said cabinet.

13. A speaker apparatus as claimed in claim 12, wherein said first acoustic tube is installed in said cabinet so that said first opening is substantially located to a node of said first standing wave.

14. A speaker apparatus as claimed in claim 11, further comprising:

a second acoustic tube which has an second opening, wherein a length of said second acoustic tube is about 1/(2m) (m=positive integer) times as large as a wave length corresponding to a lowest resonance mode of a second standing wave, wherein said second acoustic tube is disposed at a location to absorb said second standing wave produced in said cabinet.

15. A speaker apparatus as claimed in claim 14, wherein said second opening faces said first wall of said cabinet.

16. A speaker apparatus as claimed in claim 14, wherein said second opening faces a second wall of said cabinet.

17. A speaker apparatus as claimed in claim 12, wherein said first acoustic tube is installed in said cabinet so that said second opening is substantially located to a node of said second standing wave.

18. A speaker apparatus as claimed in claim 14, wherein n and m are the same number.

19. A speaker apparatus as claimed in claim 14, wherein n and m are different numbers.

20. A speaker apparatus as claimed in claim 14, wherein said second acoustic tube is disposed in a parallel direction with said first acoustic tube.

21. A speaker apparatus as claimed in claim 14, wherein said second acoustic tube is disposed in a perpendicular direction with said first acoustic tube.

22. A speaker apparatus as claimed in claim 11, wherein n is 2 or greater.

23. A speaker apparatus as claimed in claim 12, wherein m is 2 or greater.

24. A speaker apparatus as claimed in claim 14, wherein said first and second acoustic tubes have a triangular hollow section.

25. A speaker apparatus as claimed in claim 14, wherein said first and second acoustic tubes have a circular hollow section.

26. A speaker apparatus as claimed in claim 14, wherein said first and second acoustic tubes are made of paper.

27. A speaker apparatus per claim 11, wherein said cabinet is an acoustic suspension cabinet so that said first and second internal spaces do not communicate with air outside of said cabinet.

28. A speaker apparatus per claim 11, wherein said tube has an opening only at one end.

* * * * *